US008075366B1

(12) United States Patent
Jaksic et al.

(10) Patent No.: US 8,075,366 B1
(45) Date of Patent: Dec. 13, 2011

(54) MODULAR GARMENT KIT

(76) Inventors: Djuro G. Jaksic, Crown Point, IN (US); Melanie M. Jaksic, Crown Point, IN (US)

( * ) Notice: Subject to any disclaimer, the term of this patent is extended or adjusted under 35 U.S.C. 154(b) by 0 days.

(21) Appl. No.: 12/818,915

(22) Filed: Jun. 18, 2010

(51) Int. Cl.
*A41C 3/00* (2006.01)

(52) U.S. Cl. ..... 450/30; 2/105; 2/106

(58) Field of Classification Search ..... 450/58, 450/1, 36–38, 54–57, 63, 70–74, 77–80, 450/82, 86, 88, 7–35; 2/105, 106, 96, 104, 2/114, 113, 115, 78.1, 78.2, 73, 67, 69, 125, 2/126, 102, 107, 109, 110, 120, 122, DIG. 9, 2/912–915
See application file for complete search history.

(56) References Cited

U.S. PATENT DOCUMENTS

| | | | | |
|---|---|---|---|---|
| 2,250,094 | A | 7/1941 | Cornibert et al. | |
| 2,548,143 | A | 4/1951 | Christiansen | |
| 2,880,731 | A * | 4/1959 | Kendall | 450/30 |
| 3,064,265 | A * | 11/1962 | Bridgewaters | 2/74 |
| 5,097,537 | A * | 3/1992 | Ewing | 2/409 |
| 5,182,812 | A * | 2/1993 | Goldsby | 2/79 |
| 5,729,836 | A * | 3/1998 | Ewing | 2/409 |
| 6,185,741 | B1 * | 2/2001 | Kehoe | 2/67 |
| 6,240,560 | B1 * | 6/2001 | DeCaro | 2/67 |
| 6,338,161 | B1 * | 1/2002 | Ali Muhammad | 2/78.1 |
| 6,550,067 | B2 * | 4/2003 | Force | 2/104 |
| 6,935,921 | B1 * | 8/2005 | Eudenbach et al. | 450/54 |
| 7,066,784 | B2 | 6/2006 | Peay | |
| 7,343,629 | B2 | 3/2008 | Hunt | |
| 7,429,206 | B2 | 9/2008 | Perry | |
| 2004/0098783 | A1 | 5/2004 | Parson et al. | |

* cited by examiner

*Primary Examiner* — Gloria Hale
(74) *Attorney, Agent, or Firm* — Crossley Patent Law; Mark A. Crossley

(57) ABSTRACT

A modular garment kit including a brassiere and a plurality of garment members that are interchangeably attached with snaps or hook and loop fastening to the brassiere. The garment members include at least one back section, at least one sleeve section, at least one chest section and, optionally, a midsection garment member. The back section and the chest section are garment collar backs and fronts, respectively. The garment members are provided in a wide variety of styles, types, and lengths. The brassiere is provided in a variety of types, sizes, and colors.

10 Claims, 4 Drawing Sheets

MODULAR GARMENT KIT

BACKGROUND OF THE INVENTION

Various types of apparel are known in the prior art. However, what is needed is a modular garment kit including a brassiere and a plurality of garment members that are interchangeably attached with snaps or hook and loop fastening to the brassiere. The garment members include a back section which is a garment collar back, a pair of sleeve sections of varying styles, types, and lengths, and a chest section which is a garment collar front. The back section and the chest section include various types, styles, designs, and colors of garment collars. The back section and the chest section are provided as either a single unitary garment member or separately pieced garment members. One of the purposes of the present modular garment kit is to provide a garment to cover the wearer's breasts, upper torso, and arms without adding undue bulkiness about the torso of the wearer. Thus, the garment can be layered under a dress, shirt, sweater while eliminating an undergarment that has to be pulled down if the undergarment crawls upwardly.

FIELD OF THE INVENTION

The present invention relates to apparel, and more particularly, to a modular garment kit.

SUMMARY OF THE INVENTION

The general purpose of the present modular garment kit, described subsequently in greater detail, is to provide a modular garment kit which has many novel features that result in a modular garment kit which is not anticipated, rendered obvious, suggested, or even implied by prior art, either alone or in combination thereof.

To accomplish this, the present modular garment kit selectively covers the breasts and upper torso of and the arms of a wearer without adding undue bulkiness about the torso of the wearer. The kit includes at least one brassiere. The brassiere has a neck band front portion, a neck band rear portion, a torso band portion that encircles a mid-torso region of a wearer, and a pair of arm band portions. Each arm band portion encircles the arms of the wearer.

A plurality of spaced-apart securement members is attached to the neck band front portion, the neck back rear portion, and each of the arm band portions, and, optionally, to the torso band portion.

The kit also includes a plurality of garment members. Each garment member has at least one attachment edge. A plurality of spaced-apart attachment members are attached to each attachment edge of each garment member. The attachment members removably engage the securement members. The garment members interchangeably removably engage the brassiere. The garment members include at least one back section, at least one pair of sleeve sections, and at least one chest section. The back section attachment edge is disposed along a lower inside edge of the back section. The back section attachment members removably attach to the neck band rear portion securement members. The sleeve section attachment edge is disposed along an upper inside edge of each sleeve section. Each of the sleeve section attachment members removably attach to one of the arm band portion securement members. The chest section attachment edge is disposed along a bottom inside edge of the chest section. The chest section attachment members removably attach to the neck band front portion securement members. Each of the back section and the chest section is a garment collar back and front, respectively. The back section and the chest section include garment collars of various types, styles, designs, and colors.

The brassiere may be a conventional two-cupped brassiere, a sports brassiere, or any type of brassiere that will accommodate the attachments of securement members thereon and that will also support garment members attached thereto. The securement members and the attachment members are corresponding snaps or corresponding hook and loop fastener members.

To use the present modular garment kit, the wearer begins by selecting a brassiere and then by selecting at least one garment member, which may be a back section, a sleeve section, or a chest section. The wearer then selectively removably attaches the back section attachment members to the neck band rear portion securement members. The wearer selectively removably attaches the sleeve section attachment members of each sleeve section to one of the arm band portion securement members. The wearer selectively removably attaches the chest section attachment members to the neck band front portion securement members. The wearer finally dons the brassiere which has at least one of the selected garment members attached thereto.

The present kit provides a garment that can be layered under a dress, shirt, sweater while eliminating an undergarment that has to be pulled down if the undergarment crawls upwardly. The snaps may be formed of a soft plastic to reduce the potential for skin irritation. The back section, sleeve sections, and chest sections may be formed of a wide variety of fabrics from casual cotton to jersey to dressy brocade, for example. In addition, the sleeve sections are provided in varying lengths and styles, such as long, short, cropped, and bell-shaped, for example. The back section and chest section include back and front collars formed of a wide range of fabrics, styles including crew neck, button-down, V-neck and scoop neck collars, and designs such as fringed. The back and front collars may be formed as either separate garment members or as a single unitary garment member such as in the case of a turtle neck style collar. The various components of the present kit may be sold as separate components or in various component combinations. The back section, sleeve sections, and chest sections may be provided in matching or mix-and-match designs, styles, and colors, but also may be provided to contrast. The present kit provides various sizes in the back section, sleeve sections, and chest section and thus, permits more flexibility to a wearer in accommodating a particular wearer's shape and size. Because the components are interchangeable, a wearer may alternate the appearance of the garment to dress for various occasions.

In addition to the foregoing, a midsection garment member having attachment members disposed along an upper inside edge thereon may be removably attached to the brassiere utilizing the securement members disposed along the torso band portion.

The snaps and hook and loop fastening are lightweight, are formed of soft material for wearer comfort and a smooth outer appearance. Various garment members may be sewn onto the brassiere for a permanent attachment of desired garment members in combination with the utilization of snaps and/or hook and loop fasteners for other garment members.

Thus has been broadly outlined the more important features of the present modular garment kit so that the detailed description thereof that follows may be better understood and in order that the present contribution to the art may be better appreciated.

Numerous objects, features and advantages of the present modular garment kit will be readily apparent to those of ordinary skill in the art upon reading the following detailed description of presently preferred, but nonetheless illustrative, examples of the present modular garment kit when taken in conjunction with the accompanying drawings. In this respect, before explaining the current examples of the present modular garment kit in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the modular garment kit. It is therefore important that the claims be regarded as including such equivalent constructions insofar as they do not depart from the spirit and scope of the present invention.

Objects of the present modular garment kit, along with various novel features that characterize the invention are particularly pointed out in the claims forming a part of this disclosure. For better understanding of the modular garment kit, its operating advantages and specific objects attained by its uses, refer to the accompanying drawings and description.

BRIEF DESCRIPTION OF THE DRAWINGS FIGURES

DETAILED DESCRIPTION OF THE DRAWINGS

Figure 1:
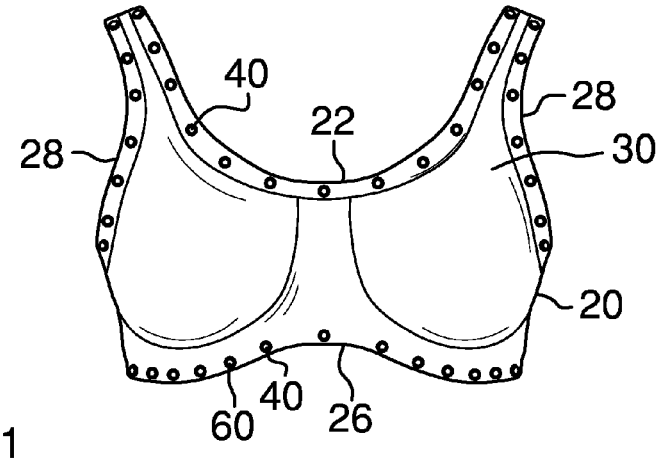
FIG. 1 is a front elevation view of a brassiere.
Figure 2:
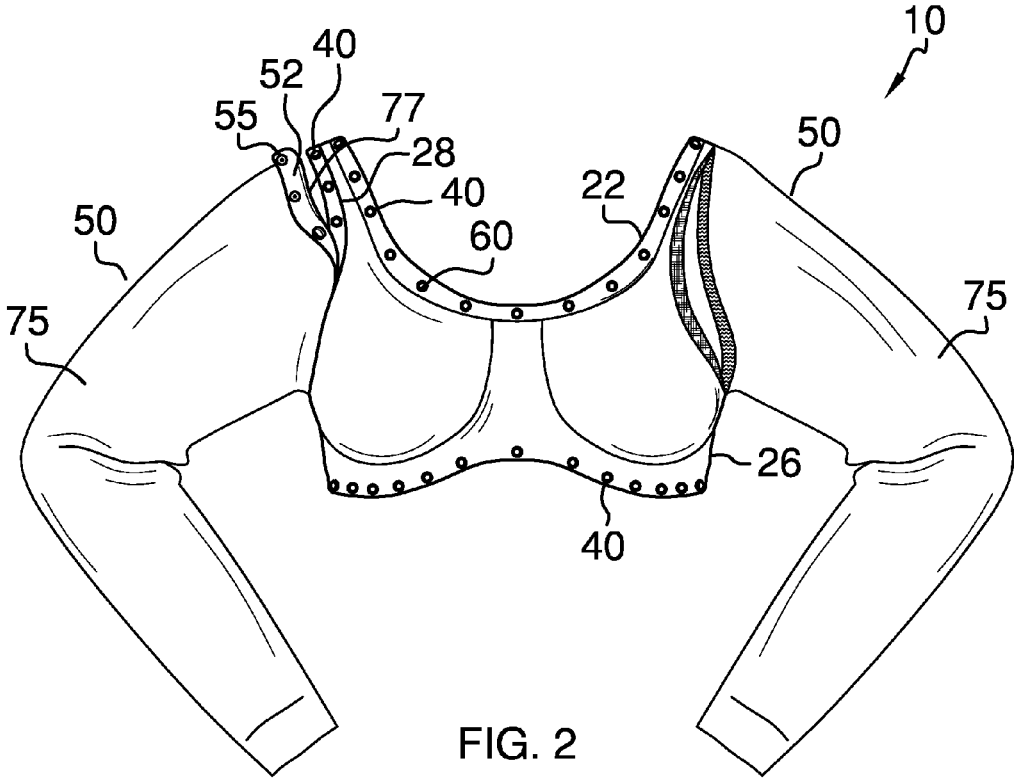
FIG. 2 is a front elevation view of a brassiere with one sleeve section attached and illustrating the attachment of another sleeve section.
Figure 3:
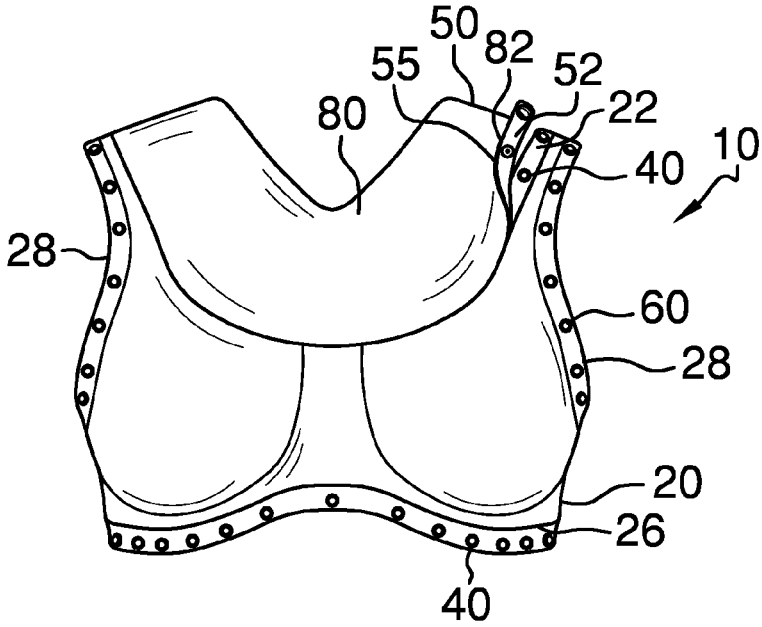
FIG. 3 is a front elevation view of a brassiere with a chest section attached thereto.
Figure 4:
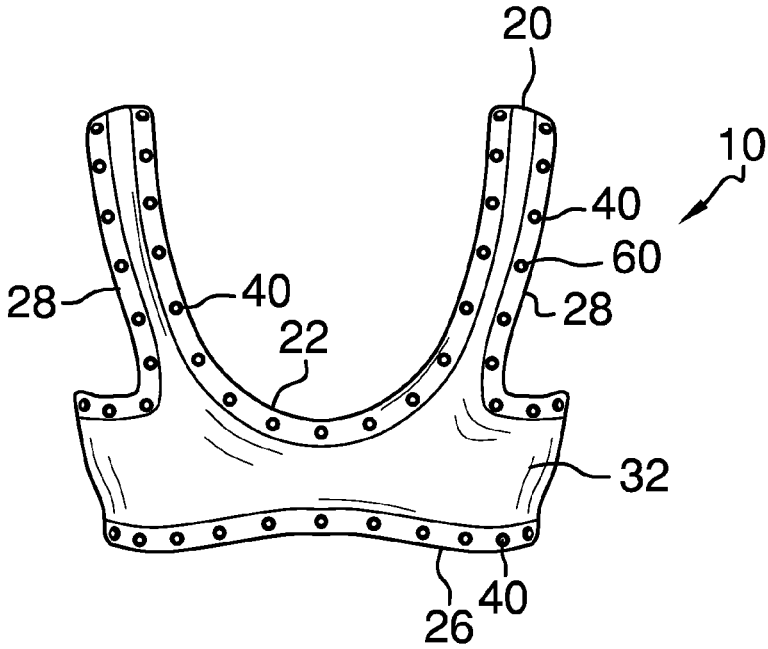
FIG. 4 is a front elevation view of sports brassiere.
Figure 5:
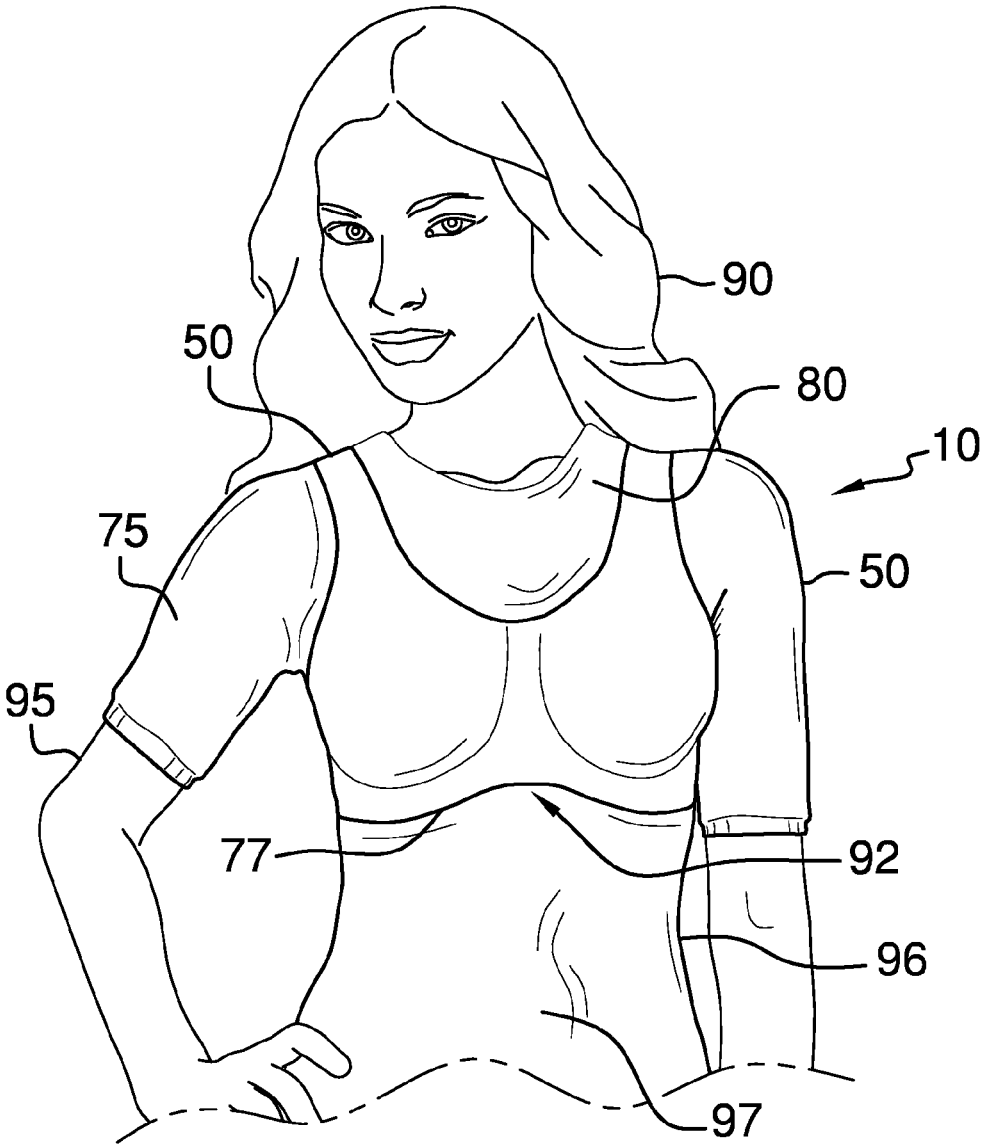
FIG. 5 is an in-use front elevation view showing a midsection garment member attached to the torso band portion.
Figure 6:
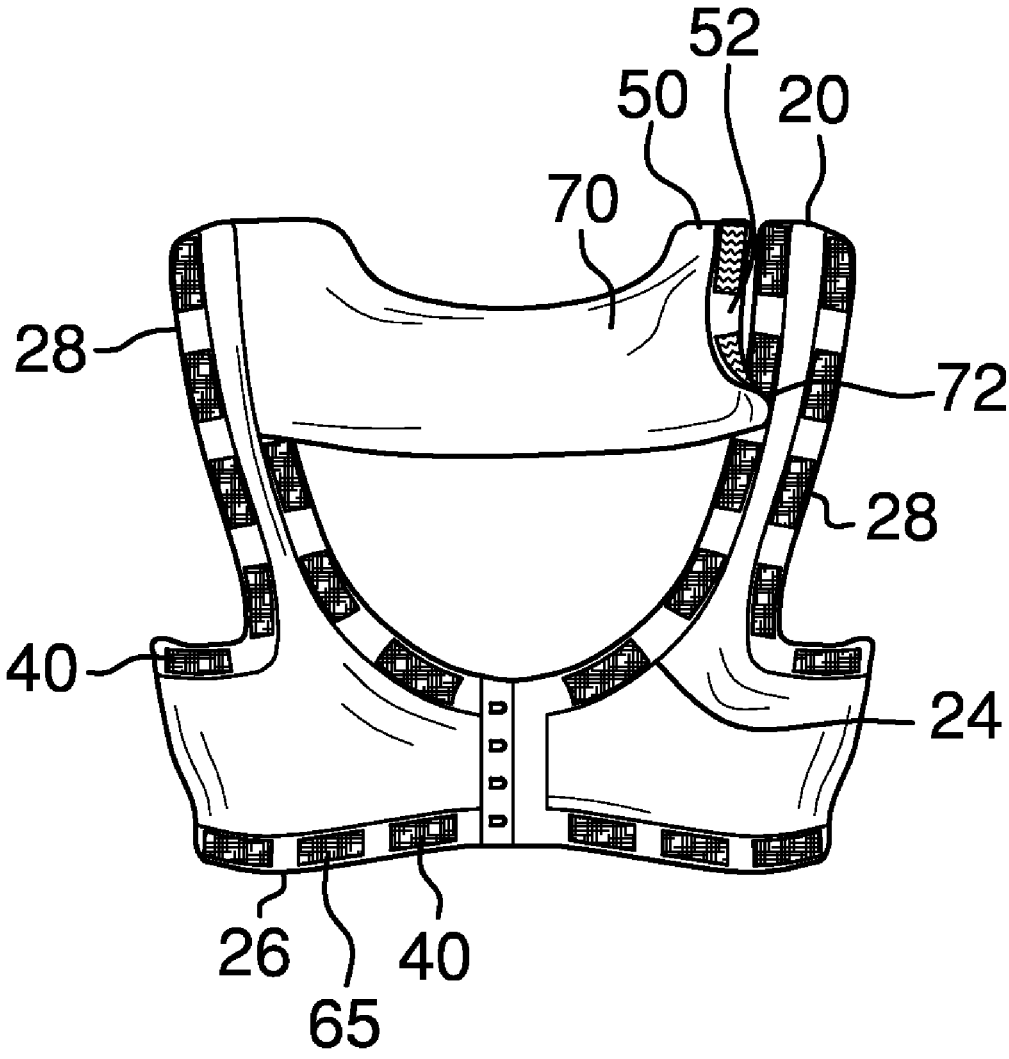
FIG. 6 is a rear elevation view of a brassiere with a back section attached thereto.

With reference now to the drawings, and in particular FIGS. 1 through 6 thereof, example of the instant modular garment kit employing the principles and concepts of the present modular garment kit and generally designated by the reference number 10 will be described.

Referring to FIGS. 1 through 6, the present modular garment kit 10 is illustrated. The modular garment kit 10 selectively covers the breasts, the upper torso region 92, the arms 95 of a wearer 90, and the midsection 96. The kit 10 includes at least one brassiere 20. The brassiere 20 has a neck band front portion 22, a neck band rear portion 24, a torso band portion 26 that encircles an upper torso region 92 of a wearer 90, and a pair of arm band portions 28. Each arm band portion 28 encircles the arms 95 of the wearer 90.

A plurality of spaced-apart securement members 30 attached to the neck band front portion 22, the neck back rear portion 24, and each of the arm band portions 28, and, optionally, to the torso band portion 26.

The kit 10 also includes a plurality of garment members 50. Each garment member 50 has at least one attachment edge 52. A plurality of spaced-apart attachment members 55 are attached to each attachment edge 52 of each garment member 50. The attachment members 55 removably engage the securement members 40. The garment members 50 interchangeably removably engage the brassiere 20.

The brassiere 20 may be a conventional two-cupped brassiere 30, a sports brassiere 32, or any type of brassiere that will accommodate the attachments of securement members 40 thereon and that will also support garment members 50 attached thereto. The securement members 40 and the attachment members 55 are corresponding snaps 60 or corresponding hook and loop fastener members 65.

The garment members 50 include at least one back section 70, at least one pair of sleeve sections 75, and at least one chest section 80. A midsection garment member 97 that covers at least a portion of the midsection 96 of the user is also provided. The back section 70 attachment edge 52 is disposed along a lower inside edge 72 of the back section 70. The back section 70 attachment members 55 removably attach to the neck band rear portion 24 securement members 40. The sleeve section 75 attachment edge 52 is disposed along an upper inside edge 77 of each sleeve section 75. Each of the sleeve section 75 attachment members 55 removably attach to one of the arm band portion 28 securement members 40. The chest section 80 attachment edge 52 is disposed along a bottom inside edge 82 of the chest section 80. The chest section 80 attachment members 55 removably attach to the neck band front portion 22 securement members 40. Each of the back section 70 and the chest section 80 is a garment collar. The midsection garment member 97 attachment edge 52 is disposed along a continuous upper inside edge 77 of the midsection garment member 97. The midsection garment member 97 attachment members 55 removably attach to the torso band portion 26 securement members 40.

Use:

To use the present modular garment kit 10, the wearer 90 begins by selecting a brassiere 20. The wearer 90 continues by selecting at least one garment member 50, which may be a back section 70, a sleeve section 75, or a chest section 80. The wearer 90 then selectively removably attaches the back section 70 attachment members 55 to the neck band rear portion 24 securement members 40. The wearer 90 selectively removably attaches the sleeve section 75 attachment members 55 of each sleeve section 75 to one of the arm band portion 28 securement members 40. The wearer selectively removably attaches the chest section 80 attachment members 55 to the neck band front portion 22 securement members 40. The wearer finally dons the brassiere 20 which has at least one of the selected garment members 50 attached thereto, thereby selectively covering the wearer's breasts, upper torso region, and arms.

The user may also attach a midsection garment member 97 by removably attaching the attachment members 55 disposed thereon to the securement members 40 of the torso band portion 26.

Alternatively, a chest section 80 and back section 70 which are formed as a single, one-piece garment member 50 is also included in the present kit 10. In addition, various garment members 50 may be sewn onto the brassiere for permanent attachment, as desired.

With respect to the above description then, it is to be realized that the optimum dimensional relationships for the parts of the present modular garment kit to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A modular garment kit for selectively creating a garment covering the breasts, the upper torso region, and the arms of a wearer, the kit comprising:

at least one brassiere, the brassiere having a neck band front portion, a neck band rear portion, a torso band portion that encircles an upper torso region of a wearer, and a pair of shoulder band portions, each shoulder band portion configured to form a sleeve opening encircling the arms of the wearer;

a plurality of spaced-apart securement members attached to the neck band front portion, the neck back rear portion, and each of the shoulder band portions;

a plurality of garment members, each garment member having at least one attachment edge;

a plurality of spaced-apart attachment members attached to each attachment edge of each garment member;

wherein the attachment members removably engage the securement members;

wherein the garment members interchangeably removably engage the brassiere.

2. The modular garment kit of claim 1 wherein the securement members and the attachment members are selected from the group consisting of corresponding snaps and corresponding hook and loop fastener members.

3. The modular garment kit of claim 1 further comprising:

a plurality of spaced-apart securement members attached to the torso band portion.

4. The modular garment kit of claim 2 wherein the garment members are selected from the group consisting of at least one back section, at least one pair of sleeve sections, and at least one chest section;

wherein the back section attachment edge is disposed along a lower inside edge of the back section;

wherein the back section attachment members removably attach to the neck band rear portion securement members;

wherein the sleeve section attachment edge is disposed along an upper inside edge of each sleeve section;

wherein each of the sleeve section attachment members removably attach to one of the shoulder band portion securement members;

wherein the chest section attachment edge is disposed along a bottom inside edge of the chest section;

wherein the chest section attachment members removably attach to the neck band front portion securement members.

5. The modular garment kit of claim 4 wherein an attachment edge of a midsection garment member is disposed along a continuous upper inside edge of the midsection garment member;

wherein a plurality of attachment members of the midsection garment member removably attach to the torso band portion securement members.

6. The modular garment kit of claim 5 wherein each of the back section and the chest section is a garment collar back and a garment collar front, respectively.

7. A method of utilizing a modular garment kit:

selecting a brassiere having a neck band front portion, a neck band rear portion, a torso band portion that encircles an upper torso region of a wearer, and a pair of shoulder band portions, each shoulder band portion configured to form a sleeve opening encircling the arms of the wearer;

selecting at least one garment member, where each garment member has at least one attachment edge;

selectively removably attaching a plurality of attachment members of a back section to a plurality of securement members of the neck band rear portion;

selectively removably attaching a plurality of attachment members of each sleeve section to each one of a plurality of securement members of the shoulder band portion;

selectively removably attaching the a plurality of attachment members of a chest section to the neck band front portion securement members;

donning the brassiere having at least one of the selected garment members attached thereto, wherein the brassiere covers a wearer's breasts and the back section, the sleeve sections, and the chest section selectively cover the wearer's upper torso and arms.

8. A method of utilizing the modular garment kit of claim 7 further comprising:

alternately permanently attaching the back section attachment members to the neck band rear portion securement members;

alternately permanently attaching the sleeve section attachment members of each sleeve section to each one of the shoulder band portion securement members; and alternately permanently attaching the chest section attachment members to the neck band front portion securement members.

9. The method of claim 8 further comprising:

selectively removably attaching a plurality of attachment members of a midsection garment member to a plurality of securement members of the torso band portion.

10. The method of claim 9 further comprising:

alternately permanently attaching the midsection garment member attachment members to the torso band portion securement members.

* * * * *